US005524129A

United States Patent [19]

Pettigrew et al.

[11] Patent Number: 5,524,129

[45] Date of Patent: Jun. 4, 1996

[54] PORTABLE COUNTER AND DATA STORAGE SYSTEM

[75] Inventors: Ronald K. Pettigrew, 1503 White Ash Dr., Carmel, Ind. 46033; Bruce E. Anderson; Raymond A. Strickland, both of Indianapolis, Ind.

[73] Assignee: Ronald K. Pettigrew, Carmel, Ind.

[21] Appl. No.: 264,478

[22] Filed: Jun. 23, 1994

[51] Int. Cl.[6] ..... G06M 1/02; G06M 1/274; G07C 9/00

[52] U.S. Cl. ..... 377/6; 340/556; 377/53

[58] Field of Search ..... 377/6, 53; 340/556

[56] References Cited

U.S. PATENT DOCUMENTS

| | | | |
|---|---|---|---|
| 3,439,320 | 4/1969 | Ward | 340/572 |
| 3,808,410 | 4/1974 | Schlesinger | 377/6 |
| 4,346,427 | 8/1982 | Blissett et al. | 361/173 |
| 4,375,034 | 2/1983 | Guscott | 250/342 |
| 4,700,295 | 10/1987 | Katsof et al. | 377/6 |
| 4,704,533 | 11/1987 | Rose et al. | 250/342 |
| 4,847,485 | 7/1989 | Koelsch | 250/221 |
| 5,119,087 | 6/1992 | Lucas | 340/825.35 |
| 5,138,638 | 8/1992 | Frey | 377/6 |
| 5,250,941 | 10/1993 | McGregor et al. | 377/6 |
| 5,305,390 | 4/1994 | Frey et al. | 377/6 |

OTHER PUBLICATIONS

Michael J. McCarthy, *James Bond Hits the Supermarket: Stores Snoop on Shoppers' Habits to Boost Sales,* Wall Street Journal, Aug. 25, 1993.

*Primary Examiner*—John S. Heyman
*Attorney, Agent, or Firm*—Leydig, Voit & Mayer, Ltd.

[57] ABSTRACT

A compact counting and data storage system includes control circuitry coupled with a detector and input selector to enable monitoring of traffic within a selected area for a selected count interval. The system also includes a readily removable data storage unit.

7 Claims, 6 Drawing Sheets

PORTABLE COUNTER AND DATA STORAGE SYSTEM

FIELD OF THE INVENTION

This invention relates to a counter and data storage system for monitoring traffic flow in a defined space. The system is self-contained within a compact enclosure and generates data corresponding to the number of persons passing into the defined space, within a preset time interval. Such data, as well as a time and date stamp of such time interval, is written to a data storage unit, preferably on a floppy disk, which may easily be removed and utilized for further processing.

BACKGROUND OF THE INVENTION

It is a desirable marketing technique to obtain statistical information concerning the traffic flow of individuals passing into a defined space in numerous retail and other commercial settings. This information, once obtained, is often utilized for various marketing and promotional strategies. For example, such information may be used for the strategic placement of advertising and promotional materials or other items within a store. In other instances, such information can be used to identify "dead spots" within a store. In this way, the efficiency of use of the space may be maximized. Likewise, such information may be used to determine whether a particular location is a viable location for a new business.

Heretofore, tracking systems used in commercial settings have typically comprised sophisticated and costly video equipment coupled with other dedicated data processing units for monitoring traffic flow in specified areas. The video equipment obtains sensing information and then sends such information, via radio frequency transmission, to the processing units. In other instances, prior systems utilize a plurality of infrared sensors that are installed in the ceilings at each aisle in a grocery store that track shopping carts passing thereby. These systems also provide circuitry, located on the shopping carts, to communicate with the sensing equipment. The carts also include displays to provide information to shoppers, while being monitored by the sensing equipment.

In still other instances, tracking systems are employed, but not for the purposes of counting traffic. For example, U.S. Pat. No. 5,119,087, issued to Lucas, discloses a shipping cart retrieval system that is used to count shopping carts. Each of the carts are equipped with a "target" that is detected by a sensor which provides an output pulse upon the detection of a cart to generate an accumulated count. The accumulated count is then compared with a predetermined value, and an alarm sounds upon the detection of a match with a prize being typically awarded to the person returning the cart. The purpose of this system, however, is to provide an incentive to return shopping carts to the store and not for monitoring traffic flow.

Other systems are known which generally monitor individuals. Likewise, they are not suited for obtaining data corresponding to traffic flow in a retail setting. For example, Koelsch's U.S. Pat. No. 4,847,485 discloses a system for monitoring the number of persons inside a pass-through by detecting and counting persons within a defined space and determining the direction of movement of the individuals. Koelsch's device, however, is used to prevent unauthorized entry or passage through a controlled portal.

Thus, apart from the dedicated complex tracking systems, the only other known alternative is to locate personnel near the entrance of a defined space to monitor traffic flow into and out of the space. Of course, this requires actual physical counting of persons as they pass into the designated area. This method is susceptible to human error, notwithstanding the requirement for retabulation of the data in many cases.

SUMMARY OF THE INVENTION

Thus, the prior art now fails to adequately meet the aforestated problems of providing adequate monitoring of traffic flow, at low cost, in a retail or commercial setting. Accordingly, the principle object of the present invention is to generally overcome deficiencies of the prior art.

More particularly, it is an object of the present invention to provide a counter and data storage system that is a contained within a portable enclosure, which can be readily installed and removed.

It is at a further object of the present invention to provide improved traffic monitoring in a counting and data storage system that includes a removable data storage device, so that accumulated data may be periodically removed for further processing.

The present invention provides these and other additional objects through an improved, low cost, counting and data storage system that is contained substantially within an enclosure. The system includes an infrared sensor located proximate a defined area to be monitored. The sensor is preferably disposed on the exterior of the enclosure and detects the presence of individuals passing into the area and provides a first signal. An input selector located within the enclosure permits the selection of a desired count interval. In addition, a control circuit also contained within the enclosure is coupled with the sensor and the input selector. The control circuit receives the first signal and provides count data including a count of individuals within the preset time interval, along with a date and time stamp corresponding with the time interval. The system also includes a removable data storage device located within the enclosure that stores the count data written thereto by the control circuit. Preferably, the data storage device is a 3.5 inch floppy disk, which may be readily removed from the system so that the count data may be periodically removed and analyzed at a remote location.

DETAILED DESCRIPTION OF THE PREFERRED EMBODIMENT

Generally, the present invention relates to a counting and data storage system that is low cost and easy to use. The system of the present invention monitors traffic flow within a selected area and periodically stores data corresponding to the number of individuals passing within a defined space in a selected time interval, along with a date and time stamp, on a removable data storage device. The counting system is substantially self-contained within a compact enclosure that ensures portability, while being readily concealed from the public.

Figure 1:
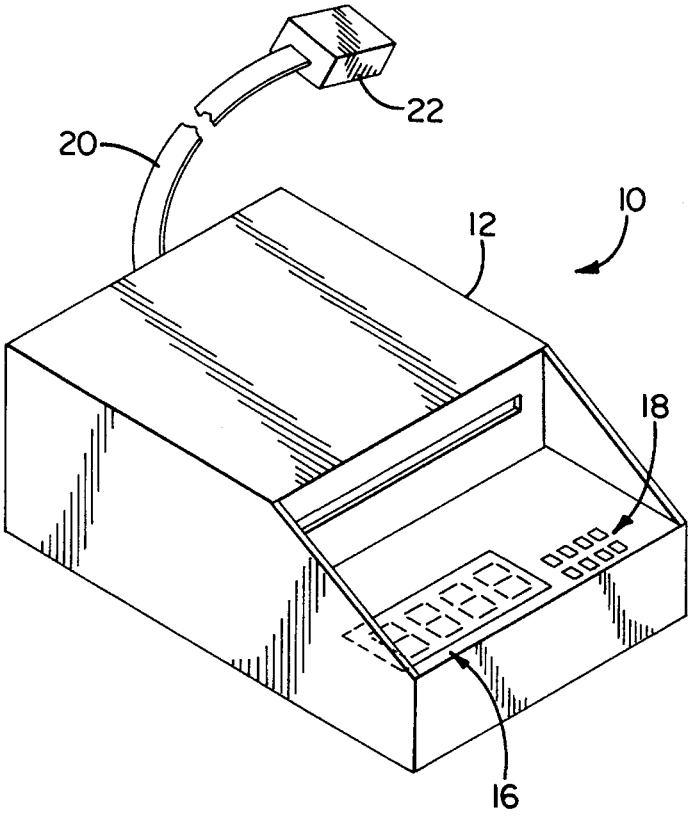
FIG. 1 is a an isometric view of a counting and data storage system of the present invention.

FIG. 1 shows a counting and data storage unit 10 according to the present invention. The unit 10 comprises an enclosure 12 that houses circuitry, as described below, and a data storage unit shown as a floppy disk 14. The unit 10 also includes a digital display 16 that provides output information to the user. In the preferred embodiment, the enclosure 12 houses various manual input selectors 18 which enables selection of various input parameters, as described in greater detail below. In addition, the enclosure 10 houses a plurality of warning and status indicator lamps 38 that also provide information to the user.

The enclosure 12 is coupled via cable 20 to an infrared sensor 22 that is placed proximate the entrance of the defined space to be monitored. The sensor 22 is preferably not contained within the enclosure 12 in order to provide greater flexibility in positioning the sensor 22, while concealing the enclosure from view by individuals passing thereby. The sensor 22, however, may also be included within the enclosure 12 and operate just as well. In the preferred embodiment, the sensor 22 is a reflective infrared sensor that provides an output signal upon the detection of an absence of a reflection, that is, when an individual interrupts the beam transmitted by the sensor 22. Those skilled in the art will appreciate that multiple sensors may be employed to obtain directional information within the defined area with appropriate modification.

The unit 10 (as well as the sensor 22) is preferably located near the entrance of the location that is being monitored, and is particularly suited for a retail or other commercial environment. Thus, for example, the unit may be placed at the entrance of a shopping center, the entrance of a store within the shopping center, or even in a specialty department within the store. By monitoring traffic flow into any of these areas, the invention provides an accurate count of number of persons sensed within a selected count interval for a given date and time. The invention stores this count data information on a removable data storage device so that the count data can be easily analyzed at a remote location.

Figure 2:
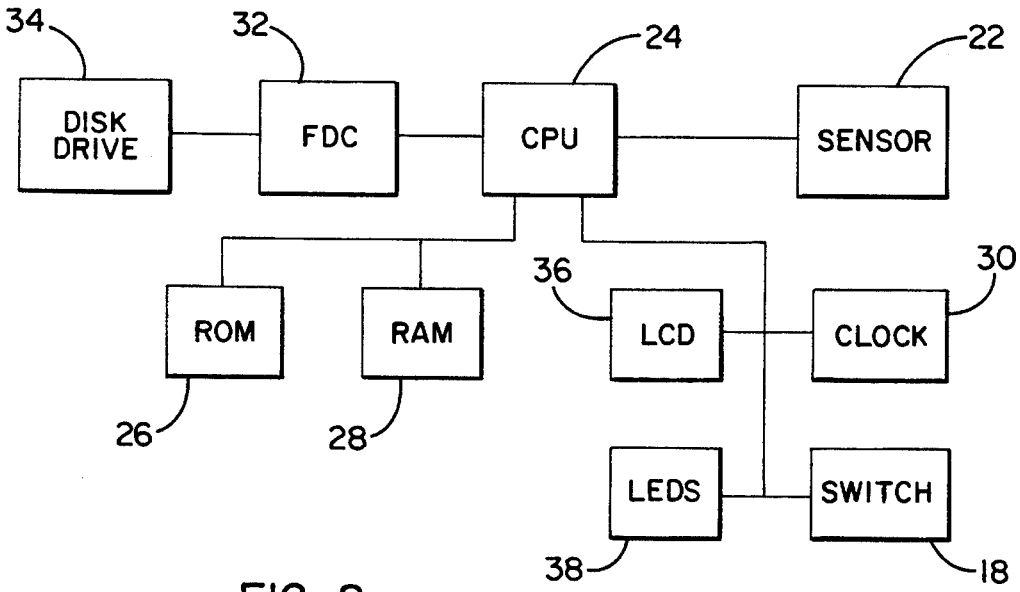
FIG. 2 is a simplified block diagram of circuitry utilized to implement the preferred embodiment of the counting and data storage system shown in FIG. 1.

FIG. 2 shows a simplified block diagram representation of the electrical circuitry for the operation and control of the system that is contained within the unit 10. As shown therein, the system comprises a microprocessor (CPU) 24 that operates in logical fashion under control of program instructions contained in read-only memory (ROM) 26. The CPU 24 is also coupled with random-access memory (RAM) 28 to store intermediate operations as well as count data and the like as will be understood by those skilled in the art. The CPU 24 is also coupled with a clock circuit 30 that provides time and date stamp information, as described in greater detail below.

Figure 3:
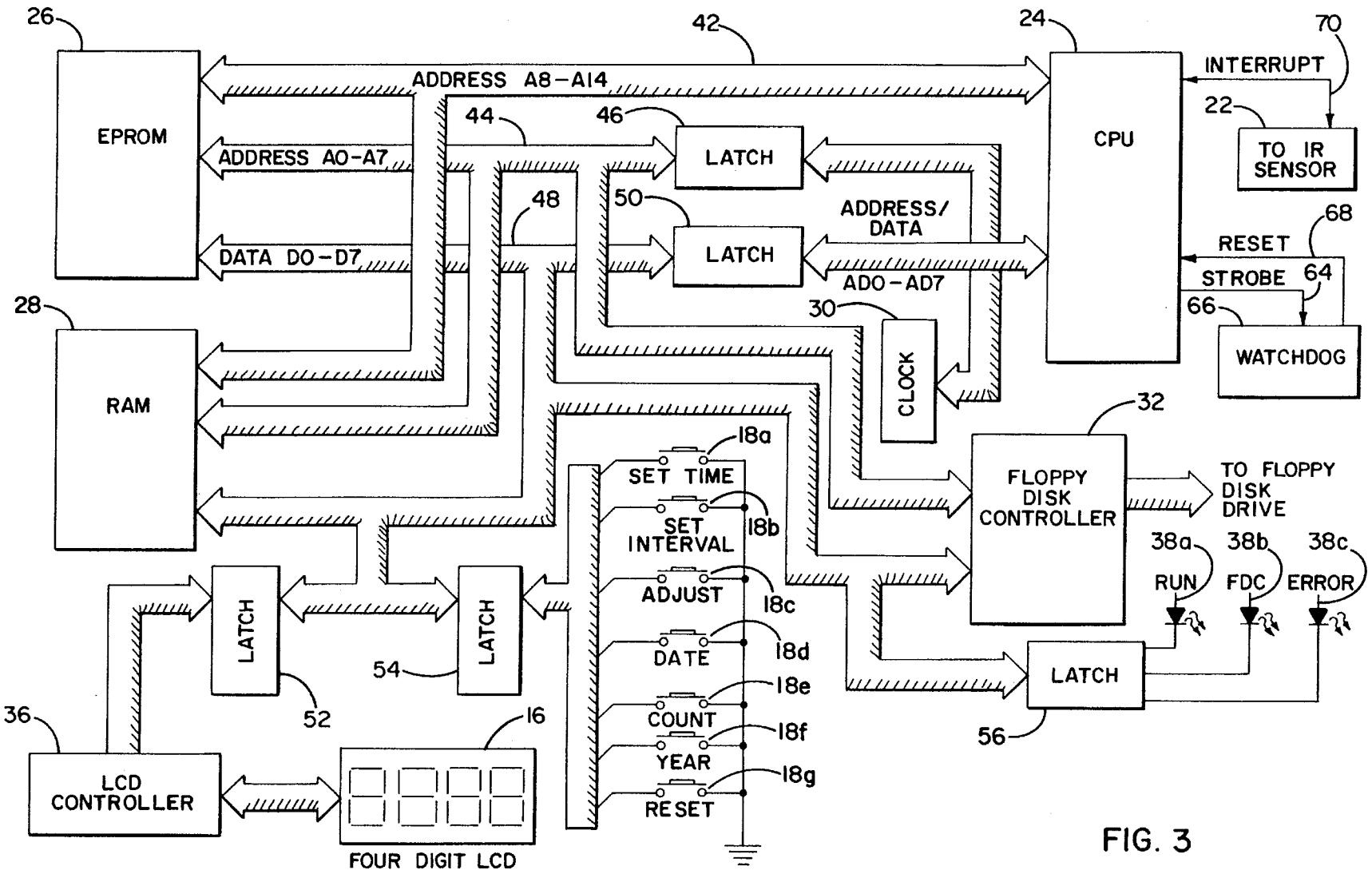
FIG. 3 is a more detailed block diagram representation of FIG. 2.

The CPU 24 receives input signals from the sensor 22 corresponding to the detection of an individual passing through a selected area. Likewise, the CPU 24 receives input information from manual selector switches 18. As best seen in FIG. 3, these selectors 18 include selection of a desired count interval denoted as selector 18*b*, a set time selector denoted by selector 18*a*, an adjust selector 18*c*, a year selector 18*d*, and a reset selector 18*e*. The selectors provide input information to the CPU corresponding to an external time and date adjust, as well as a count interval adjust.

The CPU 24 provides output control signals to a disk controller 32, which in turn, provides control for a floppy disk drive 34. In this way, count data including a time and date stamp, and a count of individuals into a defined area within a selected time interval, is written to a disk file. The CPU 24 also provides control and data signals to an LCD control and driver 36. In response, the LCD control and driver 36 provides output signals to the digital display 16 (see FIG. 1). The processor 24 also provides output signals to warning and status indicator lamps, shown as LEDs 38*a–c*.

FIG. 3 is a more detailed block diagram representation of the counter and data storage unit 10. As shown therein, the CPU 24 is connected to the ROM and RAM memories 26, 28 via address bus 42 and address bus 44. Bus 44 includes a data latch 46 to permit synchronization to and from the processor 24. A data bus 48 also couples the ROM and RAM memories 26 and 28 with the CPU 24 through data latch 50. A clock circuit 30 is also connected to address and data bus 44 and 48 and is coupled with the processor 24.

The floppy disk controller 32 receives program instructions directly from memory 26 and also has direct memory access to memory 28 via bus 44 and 48. The controller 32 provides output signals to a floppy disk drive circuit as would be understood by those skilled in the art.

A plurality of input selectors 18*a–e* are also shown as control input selectors 18 in FIG. 1. These selectors are coupled via latch 54 to address/data bus 48. Bus 48 is also connected via data latch 56 to a plurality of indicator lamps 38*a*, 38*b* and 38*c*. As shown in FIG. 3, these lamps correspond to normal operation, floppy disk controller operation and error detection, respectively.

The LCD controller circuit 36 is coupled through data latch 52 to the address/data bus 38. The LCD controller 36, in turn, provides output signals to the display 16, which is preferably a four digit liquid crystal display. In the preferred embodiment, the display normally provides an output of the date. By depressing the selectors 18, the display also provides an output of the time, and a running count for the current count interval, as described in greater detail below.

In addition, the CPU 24 periodically provides a strobe signal on a line 64 to a watchdog circuit 66. The failure of the processor 24 to provide this signal within a predetermined time interval indicates program malfunction. The absence of the strobe signal causes the watchdog circuit 66 to provide a reset signal on a line 68 to the CPU 24, thus resuming normal operation. FIG. 3 also shows the CPU 24 coupled via the line 70 to the infrared sensor 22. In response to the receipt of an interrupt signal from the sensor 22, the CPU 24 provides appropriate control signals to update an event counter as well as RAM 28. At the end of each count interval, the floppy disk controller 32 writes the accumulated count data to a disk file, as described in greater detail below.

By way of example and not by way of limitation, the circuit components for the system 10 may be of the type as follows:

| Reference Numeral | Type |
|---|---|
| 22 | 42SRU |
| 24 | 80C188 |
| 26 | EPROM 27C256 |
| 28 | RAM 62256 |
| 30 | DS 1287 |
| 32 | 82077 |
| 36 | TC7211A |
| 66 | MAX 1232 |

-continued

| Reference Numeral | Type |
|---|---|
| 46, 52, 54, 56 | 74HC573 |
| 50 | 74HC245 |

Figure 4A:
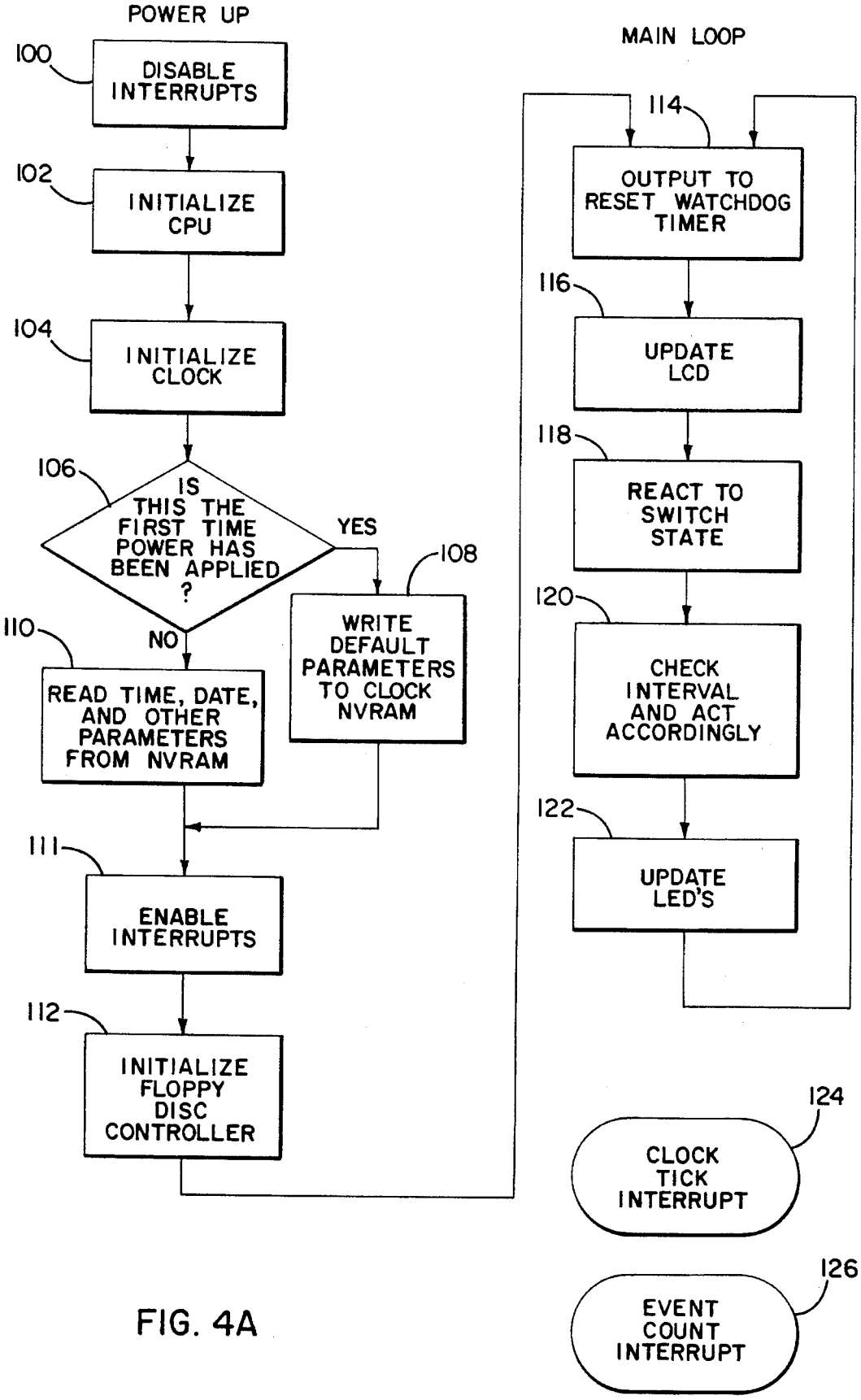
FIGS. 4*a–f* depict a logical flow diagram showing operation of the circuitry shown in FIGS. 2 and 3.

FIGS. 4*a–f* illustrate a logical flow diagram of the data storage system of the present invention. As shown jointly in FIGS. 3 and 4*a*, the system begins by disabling the interrupts (described hereinafter) at a block 100 and then proceeds to initialize the CPU 24 and clock and start the clock circuit 30 (see FIG. 3) at a block 102 (FIG. 4*a*). Next the system proceeds to decision block 106 and determines if power has previously been applied to the unit. If this is the first time on, the default operating parameters are loaded to system memory at a block 108. Otherwise, the previously saved valves stored in non-volatile memory of the clock are loaded as the system parameters at a block 110. The system then advances to a block 111 where the CPU 24 is enabled to receive interrupts. Thereafter, at a block 112, the floppy disk controller 32 is initialized.

The system then advances to a background program or main operating loop and provides output signals to reset the watchdog timer circuit 66 at a block 114. At a next block 116, the system updates the LCD controller 36. The system then advances to a subroutine shown by a block 118 where the system reacts to the current state of manual input selectors 18*a–g*, as described in greater detail below. Next, the system advances to a next subroutine shown by a block 120 and checks whether the selected time interval has elapsed. The system then updates output supplied to the indicator lights at block 122. Finally, the system returns to block 114 and continues.

FIG. 4*a* also shows a "clock tick" interrupt routine denoted by a block 124 and an event count interrupt routine denoted by block 126 which are processed on the occurrence of the interrupt. These interrupts are shown in greater detail in FIGS. 4*e* and 4*f*, respectively.

Figure 4B:
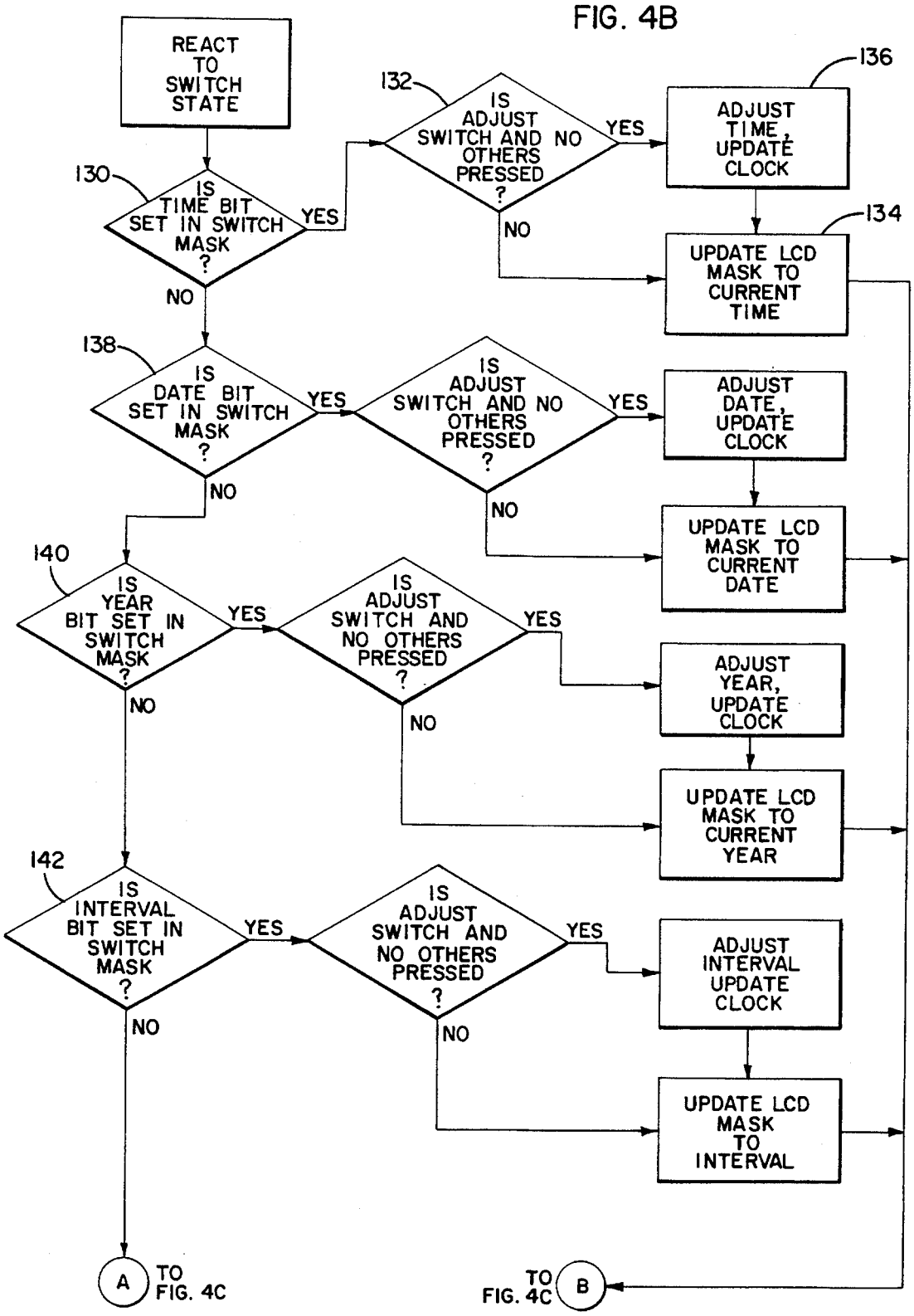
Figure 4C:
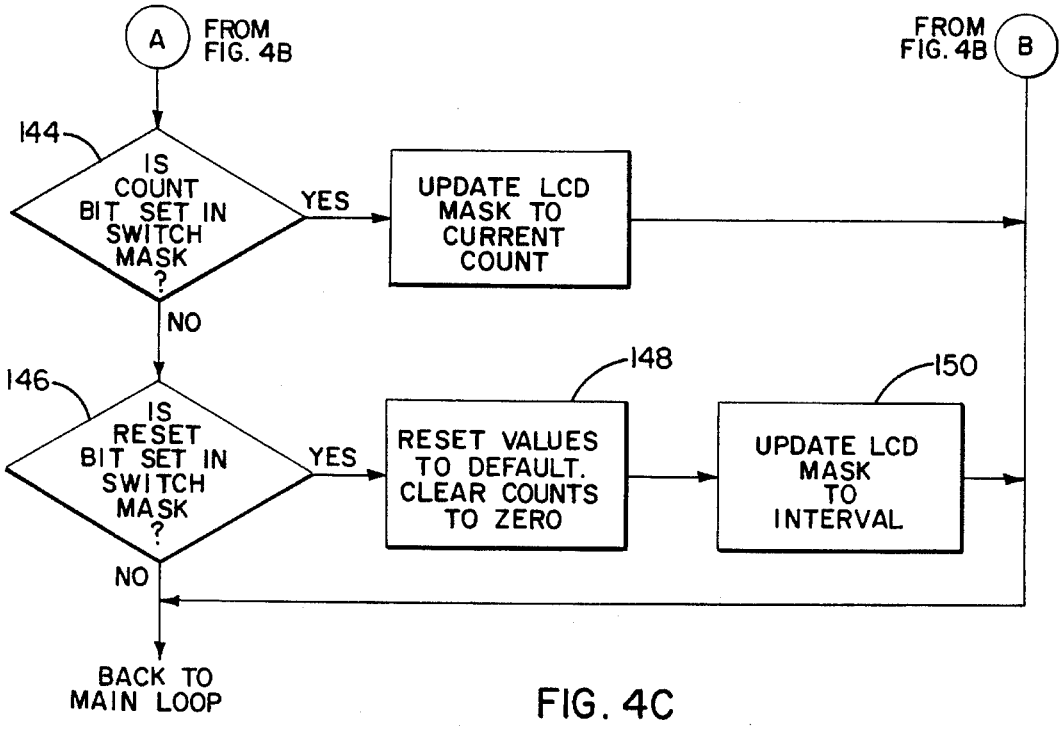

FIGS. 4*b–c* show the details of the react to switch routine (denoted by the block 118 in FIG. 4*a*) wherein the state of manual input selectors 18*a–g* is examined. In the preferred embodiment, all selector input scanning is performed during the "clock tick" interrupt routine (block 124). This interrupt routine then sets the appropriate bits in a switch mask byte to reflect the state of the switches. The switches are used to adjust time, date, count interval, and for viewing the current count.

The react to switch state routine begins at a decision block 130 where the system determines whether the time bit is set in the switch mask byte which indicates that the set time switch 18*a* has been pressed. If, at block 130, the system determines that the time bit is set, the system advances to a decision block 132 and determines whether the bit corresponding to depression of the adjust switch 18*c* is set. If no, the system advances to a block 134 and updates an LCD display word (comprising two bytes) to the current time. If, on the other hand, the adjust switch is depressed, the system advances to a block 136 and adjusts the time as well as updates the clock. Thereafter, the system updates the LCD display word to the current time at block 134 and returns to the main loop. The system examines the date bit, the year bit, and the interval bit in the switch mask byte at decision blocks 138, 140 and 142 and updates in the same manner. In the preferred embodiment, the intervals may correspond to 1, 5, 10, 20 or 30 minutes.

The system also determines whether a count bit is set in the switch mask byte corresponding to depression of the count selector 18*e* at a decision block 144. If yes, the system advances to a block 146 and updates the LCD display word to the current accumulated count in the interval. Thereafter the system returns to the main loop.

The system also determines whether a reset bit in the switch mask byte is set at a decision block 146. If no, the system returns to the main loop. On the other hand, if the system determines at decision block 146 that the reset switch bit is set, the system advances to a block 148 and resets the values to default. In addition, the system clears the count to zero. The system then advances to a block 150 and updates the LCD display word to the current interval. The system then returns to the main loop.

Figure 4D:
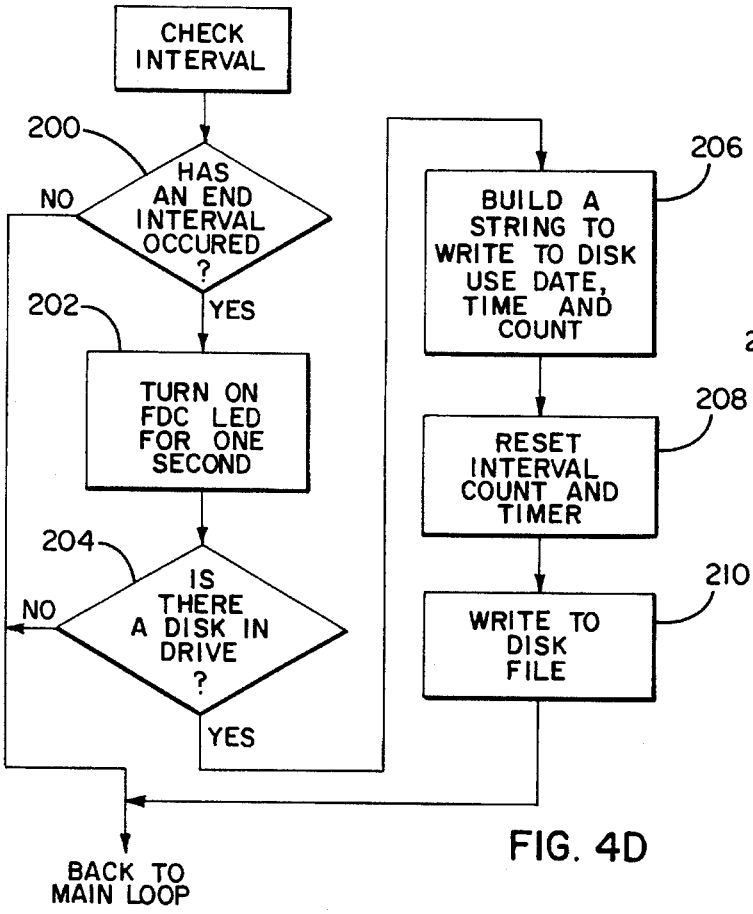

FIG. 4*d* is a flow diagram of the check interval routine denoted by the block 120 in FIG. 4*a*. During this routine, the system advances to a decision block 200 and determines whether the end of a selected count interval is detected. The selected count interval is the desired interval at which the system writes data to the disk file. If no, the system advances to the main loop. On the other hand, if the system detects an end of the selected count interval, the system advances to a block 202 and turns on the floppy disk controller indicator lamp for one second prior to writing to the disk file. The system then advances to a decision block 204 and determines whether there is a disk present in the disk drive. If no, the error LED mask bit is set and the system returns to the main loop. If yes, the system advances to a block 206 and builds a data string to write to the disk as will be understood by those skilled in the art. Such data includes the date stamp, time stamp, numerical count and count interval. In the preferred embodiment, data corresponding to the count interval is stored as a beginning and ending time of the interval. The system then advances to a block 208 and resets the interval count and timer. Finally, the system advances to a block 210 and writes to the disk file, turns off the FDC indicator lamp, and then returns to the main loop and continues.

Figure 4F:
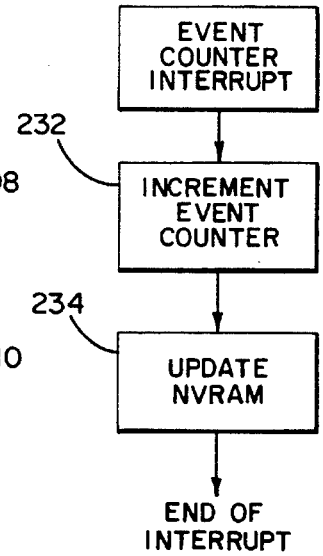
Figure 4E:
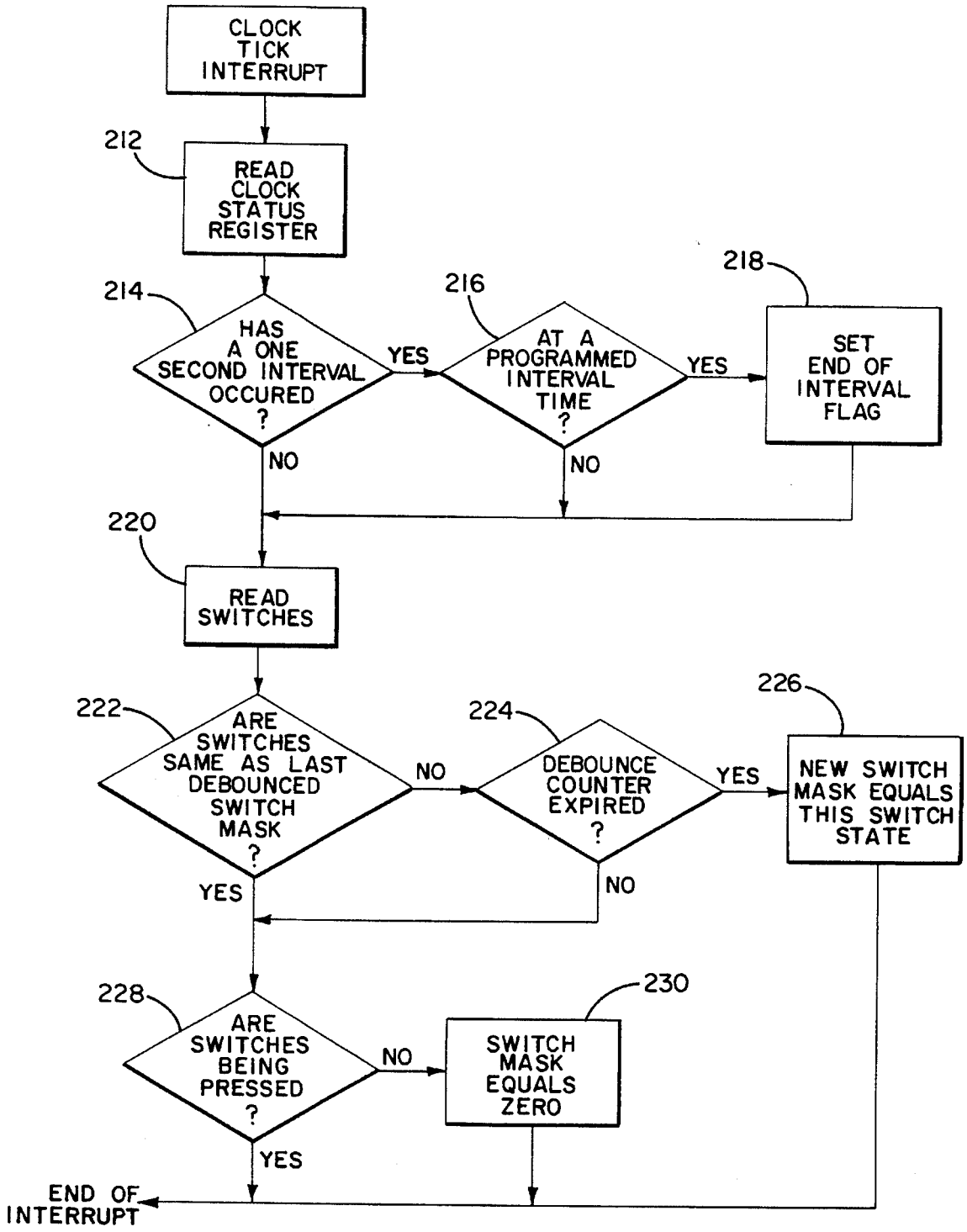

FIG. 4*e* is a more detailed diagram of the "clock tick" interrupt denoted by the block 124 in FIG. 4*a*. The "clock tick" interrupt operates on receipt of an output signal from the clock chip that occurs 16 times per second. During this interrupt, the system first receives the "clock tick" interrupt. The system then advances to a block 212 and reads the status register of the clock circuit. Next, the system advances to a decision block 214 and determines from the status byte read from the status register in the clock chip whether a one second interval has occurred. If yes, the system advances to a decision block 216 and determines whether the interval has occurred at a programmed interval time. If yes, the system advances to a block 218 and sets an end of interval flag. The system then branches to a block 220 and reads the selector switches. On the other hand, if at either decision block 214 or 216, the system determines that one second interval has not occurred or that the interval has not occurred at a programmed time interval, the system advances to a block 220. The system then advances to a decision block 222 and determines whether the switches are the same as the last debounce switch mask. If no, the system determines whether the debounce counter has expired as a decision block 224. If at decision block 224, the counter has expired, the system advances to a block 226 and sets the new switch mask equal to the detected states of the selector switches. The system then terminates the interrupt.

On the other hand, if either at decision block 222 the switches are not the same as the last debounce switch mask or at decision block 224 the debounce counter has not expired, the system advances to a decision block 228 and determines whether any switches are being pressed. If yes, the system terminates the interrupt. If at decision block 228 the system detects that no switches are being pressed, the system advances to a block 230 and sets the switch mask equal to zero. The system then terminates the interrupt.

FIG. 4*f* is a more detailed flow diagram of the event counter interrupt 126. As shown therein, upon receipt of the event counter interrupt signal, the system advances to a block 232 and increments the event counter. The system then advances to a block 234 and updates the nonvolatile memory in the clock chip. The system then terminates the interrupt.

Various advantages flow readily from the disclosed counting and data storage system. For example, the system of this invention achieves an extremely accurate count of individuals that enter a specified area within a desired time interval. In addition, a dramatic decrease in the amount of equipment is required to provide more useful information in the same commercial environment. That is, where a previous system may employ video equipment in conjunction with dedicated computer equipment, the present invention can provide the same information, with a substantially self-contained and compact unit, from which data can be readily be transferred for further processing. Likewise, the unit can be easily moved to various locations with minimum effort. Thus, the present invention provides significant improvements over the prior art, improvements that are manifested in improved performance and diminished cost.

Accordingly, a counting and data storage system meeting the aforestated objectives has been described. The counting system is easily preset to provide monitoring of individuals within a selected time interval, while being substantially self-contained. Various modifications as would be apparent to one of ordinary skill in the art and familiar with the teaching of this application are deemed to be within the scope of this invention. The precise scope of the invention is set forth in the appended claims.

What is claimed is:

1. A system for monitoring traffic flow of individuals passing a selected location comprising:

a portable enclosure;

sensor means located at the selected area and coupled with the enclosure for detecting the presence of an individual passing into the selected area and for providing a first signal;

an input selector disposed on the portable enclosure for permitting the selection of a desired count interval;

a computing and control circuit contained within the enclosure and coupled with the sensor means and the input selector, the computing and control circuit receiving the first signal and providing count data corresponding to a count of individuals within the preset time interval and a date and time stamp; and, a data storage controller circuit contained within the enclosure and coupled with the computing and control circuit for writing the count data to a data storage device, the data storage device being selectively removable from the enclosure.

2. The invention as in claim 1 wherein the data storage device is a floppy disk.

3. The invention as in claim 2 further comprising a display coupled with the processor for providing output information corresponding to the count data.

4. The invention as in claim 1 wherein the count data includes the date and time corresponding to the count and time interval.

5. The invention as in claim 1 wherein the sensor means is a reflective infrared detector.

6. A counting and data storage system for monitoring individuals passing a selected location comprising:

sensor means located at the selected area for detecting the presence of an individual passing into the selected area and for providing a first signal;

input selector means for permitting the selection of a desired count interval;

control means coupled with the sensor means and the input selector means, the control means receiving the first signal and for providing count data including a count of individuals within the preset time interval and a date and time stamp;

a transportable data storage device for storing the count data supplied by the control means; and, a portable enclosure housing the input selector means, the control means, and the data storage device, the enclosure permitting hand access and selective removal of the data storage device.

7. A counting and data storage system for monitoring individuals passing into a selected location comprising:

a sensing unit located at the selected location including a first sensor and a second sensor disposed proximate the first sensor, the first and second sensors detecting the presence of an individual passing into the selected area and providing first and second signals;

a portable enclosure;

a computing and control circuit disposed within the portable enclosure and coupled with the sensing unit receiving the first and second signals and for providing count data including a count of individuals entering the selected location within a preset time interval and date and time stamp; and, a data storage device selectively removable from the enclosure for storing the count data supplied by the computing and control circuit.

* * * * *